US012805558B2

(12) United States Patent
Mishra et al.

(10) Patent No.: US 12,805,558 B2
(45) Date of Patent: Nov. 24, 2026

(54) IMMOBILIZED ADDITIVE INSERTS

(71) Applicant: Philip Morris USA Inc., Richmond, VA (US)

(72) Inventors: Munmaya K. Mishra, Richmond, VA (US); Jay A. Fournier, Richmond, VA (US); Marc R. Krauss, Midlothian, VA (US); Douglas A. Fernandez, Richmond, VA (US); Peter J. Lipowicz, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 1258 days.

(21) Appl. No.: 17/577,105

(22) Filed: Jan. 17, 2022

(65) Prior Publication Data

US 2022/0132911 A1 May 5, 2022

Related U.S. Application Data

(60) Continuation of application No. 16/018,220, filed on Jun. 26, 2018, now Pat. No. 11,229,233, which is a (Continued)

(51) Int. Cl.
*A24C 5/60* (2006.01)
*A24B 15/28* (2006.01)
(Continued)

(52) U.S. Cl.
CPC ..... *A24C 5/60* (2013.01); *A24B 15/282* (2013.01); *A24D 1/002* (2013.01); *A24D 3/061* (2013.01)

(58) Field of Classification Search
None
See application file for complete search history.

(56) References Cited

U.S. PATENT DOCUMENTS 656,479 A 8/1900 Shellenbach
1,743,481 A 1/1930 Rench
(Continued)

FOREIGN PATENT DOCUMENTS

EP 1285886 A2 2/2003
GB 1285886 A 8/1972
(Continued)

OTHER PUBLICATIONS

International Search Report (PCT/SIA/210) dated Feb. 13, 2008, by the European Patent Office in corresponding International Application No. PCT/IB2007/003081. (2 pages).
(Continued)

*Primary Examiner* — Michael J Felton
(74) *Attorney, Agent, or Firm* — Harness, Dickey & Pierce, P.L.C.

(57) ABSTRACT

Delivery of additives in a smoking article is provided through thermally degradable, robust immobilized additive inserts. Additives can be immobilized in an elongated device or an insert, wherein the elongated device or the insert is sufficiently robust to allow the elongated device or the insert to be manually or machine inserted into a smoking article while maintaining the structure of the elongated device or the insert. By providing additives in the form of thermally degradable immobilized additive inserts, migration and/or loss of the additives in a smoking article prior to smoking can be reduced.

19 Claims, 5 Drawing Sheets

Related U.S. Application Data continuation of application No. 14/669,590, filed on Mar. 26, 2015, now Pat. No. 10,028,523, which is a division of application No. 13/619,422, filed on Sep. 14, 2012, now Pat. No. 9,011,603, which is a division of application No. 11/812,026, filed on Jun. 14, 2007, now Pat. No. 8,282,739.

(60) Provisional application No. 60/835,088, filed on Aug. 3, 2006.

(51) Int. Cl.
*A24D 1/00* (2020.01)
*A24D 3/06* (2006.01)

(56) References Cited

U.S. PATENT DOCUMENTS 1,836,237 A 12/1931 Gonsett et al.
1,972,118 A 9/1934 McDill
2,007,632 A 7/1935 Blank et al.
2,072,361 A 3/1937 Ehrig et al.
2,333,049 A 10/1943 Shapiro
3,162,199 A * 12/1964 Moll, Jr. ..... A24D 1/002 131/274
3,258,015 A 6/1966 Ellis et al.
3,312,226 A * 4/1967 Bavley ..... A24B 15/281 558/275
3,319,632 A 5/1967 Burbig
3,356,094 A 12/1967 Ellis et al.
3,576,249 A * 4/1971 Grissinger ..... B65G 37/00 198/816
3,863,644 A 2/1975 Hunt
3,865,121 A * 2/1975 Molins ..... A24D 3/0283 131/340
4,123,592 A 10/1978 Rainer et al.
4,142,534 A 3/1979 Brantl
4,304,245 A 12/1981 Lichfield
4,449,541 A 5/1984 Mays et al.
4,776,354 A * 10/1988 Norman ..... A24D 1/00 131/365
4,805,646 A 2/1989 Shimenkov
4,807,648 A 2/1989 Breckwoldt
4,924,886 A 5/1990 Litzinger
4,984,588 A 1/1991 Stewart, Jr.
5,133,367 A 7/1992 Keritsis
5,285,798 A 2/1994 Banerjee et al.
5,499,636 A 3/1996 Baggett, Jr. et al.
5,666,976 A 9/1997 Adams et al.
5,692,525 A 12/1997 Counts et al.
5,692,526 A 12/1997 Adams et al.
5,915,387 A 6/1999 Baggett, Jr. et al.
5,988,176 A 11/1999 Baggett, Jr. et al.
6,026,820 A 2/2000 Baggett, Jr. et al.
6,584,979 B2 7/2003 Xue et al.
6,637,439 B2 10/2003 Hajaligol et al.
6,772,768 B2 8/2004 Xue et al.
6,779,528 B2 8/2004 Xue et al.
7,074,170 B2 7/2006 Lanier, Jr. et al.
8,282,739 B2 10/2012 Mishra et al.
2003/0224918 A1 12/2003 Lanier, Jr. et al.
2005/0058609 A1 3/2005 Nazeri
2005/0098193 A1 5/2005 Tsaur
2005/0133053 A1 6/2005 Fournier et al.
2006/0144412 A1 * 7/2006 Mishra ..... A24B 15/283 131/337

FOREIGN PATENT DOCUMENTS

WO WO-2005/046505 A1 5/2005
WO WO-2005/1046505 5/2005

OTHER PUBLICATIONS

International Preliminary Report on Patentability and the Written Opinion of the International Searching Authority ( PCTIB373 and PCT/ISA/237) dated Feb. 3, 2009, by the International Bureau of WIPO in corresponding International Application No. PCT/IB2007/003081. (9 pages).
International Search Report and Written Opinion dated Feb. 13, 2008 for PCT/IB2007/003081.
International Preliminary Report on Patentability issued Feb. 3, 2009 for PCT/IB2007/003081.

* cited by examiner

IMMOBILIZED ADDITIVE INSERTS

CROSS-REFERENCE TO APPLICATIONS

This application is a continuation application of U.S. patent application Ser. No. 16/018,220, filed Jun. 26, 2018, which is a continuation application of U.S. patent application Ser. No. 14/669,590, filed Mar. 26, 2015, which is a divisional application of U.S. patent application Ser. No. 13/619,422, filed Sep. 14, 2012, now U.S. Pat. No. 9,011,603, issued Apr. 21, 2015, which is a divisional application of U.S. patent application Ser. No. 11/812,026, filed Jun. 14, 2007, now U.S. Pat. No. 8,282,739, issued Oct. 9, 2012, which claims priority under 35 U.S.C. § 119(e) to U.S. Provisional Application Ser. No. 60/835,088, filed Aug. 3, 2006, of which the entire content of each is herein incorporated by reference.

BACKGROUND

Additives can be added to smoking articles to provide characteristics of the additives in the smoking articles. However, the additives can be lost through evaporation, absorption, adsorption, etc. during storage of the smoking articles. This loss occurs especially if the smoking articles include sorbent materials therein as the sorbent can rapidly absorb or adsorb additives.

Accordingly, there is interest in providing additives, such as flavorants, diluents, sorbents, combustion rate controlling compositions, humectants, or combinations thereof, in smoking articles containing sorbent materials, wherein the additives are protected from loss.

SUMMARY

Immobilized additive inserts, which are thermally degradable and robust, are provided herein to supply additive to a smoking article. By providing additives immobilized within inserts, loss of the additives can be reduced as the inserts can protect the additives from loss to the environment (i.e., evaporation), as well as loss to sorbents in a smoking article (i.e., sorption). Additionally, by providing additives immobilized within inserts, heat from the smoking of the smoking article can release the additives. Also, by providing sufficiently robust inserts, the inserts can be easily used with smoking articles, wherein the inserts can be used by smokers with any type or brand of smoking article. By providing separately insertable additive inserts, as many or as few inserts as desired can be used to provide as much or as little additives per cigarette as desired.

In an exemplary embodiment is provided a cigarette, which comprises: a tobacco rod; an optional filter attached to the tobacco rod; a thermally degradable, robust immobilized additive insert within the tobacco rod, wherein the insert is sufficiently robust that the inserts are capable of maintaining their structure when manually or machine inserted into the tobacco rod; a cavity within the insert; and one or more additives within the cavity.

In another embodiment is provided a cigarette, which comprises: a filter including a sorbent on one end of the cigarette; a tobacco rod on the other end of the cigarette; and one or more inserts within a tobacco filler of the tobacco rod, wherein the one or more inserts comprise one or more elongated devices; and one or more additives within the one or more elongated devices.

In another embodiment is provided a kit, which includes: a smoking article; and a thermally degradable immobilized additive insert, wherein the insert is adapted to be inserted into the smoking article, and wherein the insert comprises an elongated device with an elongated hollow region therein; and an additive within the elongated hollow region therein is provided.

In another embodiment is provided a method of forming an additive-containing smoking article, which comprises: providing a smoking article; forming a thermally degradable, robust, immobilized additive-containing insert by: (1) forming a hollow region in an elongated device and adding additives into the hollow region; (2) pressurizing an absorbent elongated device in an additive containing pressurized vessel to a pressure of at least 20 psi, preferably at least 100 psi, more preferably at least 200 psi; (3) encapsulating additives within a leak-resistant elongated device; (4) layering additive-containing tobacco sheets, and forming the insert from the layered additive-containing tobacco sheets; (5) infusing additives by vacuum infiltration; or (6) any combination thereof; and manually or machine inserting the insert into the smoking article, wherein the insert is sufficiently robust to maintain its original shape during its insertion into the tobacco of a smoking article.

DETAILED DESCRIPTION

Figure 1:
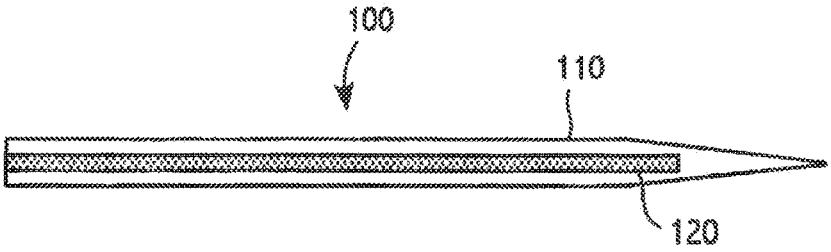
FIG. 1 is an illustration of an exemplary immobilized additive insert.

In order to reduce loss of additives in a smoking article, an immobilized additive insert is disclosed herein. These immobilized additive inserts can be manually or machine inserted into a smoking article to provide additives to smoking articles. By providing immobilized additive inserts for smoking articles, additives can be immobilized within the inserts to reduce interaction between the additives and either the environment or the smoking articles. This reduced interaction can be realized by physical separation of the additives from the environment (e.g., encapsulation, immobilization) or from the smoking articles (e.g., separate packaging, encapsulation, immobilization). As discussed below, additives within the exemplary inserts are thermally releasable, wherein release of the additives can occur upon heating of the insert.

A. Thermal Release of Additives

In order to release the additives from the inserts, the inserts can be provided in a heating zone, wherein the inserts can be heated to at least partially degrade the inserts, thus releasing the additives. In other words, the inserts can be thermally heated and/or pyrolyzed along with tobacco in a tobacco rod resulting in release of the additive from the insert.

As used herein, "heated" or "heating" is intended to include elevating the temperature of an insert to the point at which volatilization, thermal degradation, combustion, pyrolyzation, etc. occur such that the insert releases additive through at least partial degradation of at least a portion of the insert.

The heating of inserts causes the additive to be released from the inserts, e.g. by at least partial thermal degradation of the inserts. For example, temperatures between 50° C. and 900° C., or between 100° C. and 800° C. (e.g., above 50, 100, 200, 300, 400, 500, 600, 700, 800° C.) can be used for thermally degrading the insert, as well as mobilizing the additives and releasing the additives from the inserts.

Consequently, without the application of heat, the additive remains immobilized within the inserts and is therefore substantially prevented from interacting with a smoking article or with the environment, and therefore substantially prevented from deactivating any sorbent in the smoking article prior smoking.

In accordance with one embodiment, one or more inserts are incorporated in a smoking article, such as a cigarette, wherein an optional filter employed in the cigarette includes an optional sorbent (absorbent or adsorbent). Preferably, the one or more inserts are inserted into the tobacco rod of the cigarette, so that the one or more inserts will be exposed to heat when the cigarette is smoked. By exposing the one or more inserts to the heat generated by the combustion of the tobacco rod, additives can be thermally released into the mainstream smoke formed by the combustion of the tobacco.

B. Immobilization of Additives

As used herein, "immobilized additives" are intended to include additives which are substantially isolated from surrounding material, with reduced mobility and migration, such that the additives have reduced interaction with the environment prior to mobilization. For example, immobilized additives can include additives provided in inserts.

The levels of additives in inserts can be widely varied depending upon the methods of forming the inserts, the weight and infusibility of the additives, the weight and capacity of the containment portion of the inserts, etc. The amounts of the additives in the inserts can be determined based upon the loading capacity of the inserts and the levels of immobility of the additives within the inserts. In other words, while a high level of additives may be desired, if the additive level is too high to be immobilized within the containment portion of the insert, then additives may be lost due to lack of containment (i.e., leakage or evaporation). In exemplary embodiments, each insert includes between 5 and 50 mg of additives, or between 15 and 35 mg of additives.

Immobilized additive inserts can be formed by trapping or immobilizing additives within elongated devices. Exemplary methods include: 1) forming inserts by infusing additives into the inserts under high pressure; 2) forming inserts by filling cavities in inserts with additives; 3) forming inserts by encapsulating additives within inserts; 4) forming inserts by layering tobacco sheets pre-loaded with additives, 5) infusing additives by vacuum infiltration, as well as 6) combinations of any of these.

In exemplary embodiments, the immobilized additive inserts are thermally degradable such that an application of heat can release the additives. Additionally, the immobilized additive inserts are sufficiently robust and at least somewhat rigid to allow for manual or machine insertion of the inserts into tobacco rods of cigarettes or other smoking articles and to allow the inserts to maintain their structure without breaking or losing their original shape.

1) Infusing Additives

In exemplary embodiments of infusing additives within inserts, an immobilized additive insert can be formed by placing an elongated device within a pressure vessel with additives therein. Next, the pressure vessel can be pressurized and held at that pressure until the elongated device is sufficiently infused with additives. Alternatively, the vessel containing the elongated device and additive can be placed under vacuum in a vacuum chamber or pressure vessel equipped with a vacuum pump for a period of time sufficient for additive to infuse and be taken up by the material of the elongated device. Alternatively, a combination of vacuum and pressurization infusion techniques can be used to infuse additive, e.g., by placing the elongated device in the pressure vessel equipped with a vacuum pump (e.g., a vacuum pump rated for $10^{-4}$ Torr), placing the elongated device under vacuum by evacuating the pressure vessel with the vacuum pump, charging the additive to the vessel, and then pressurizing. After infusion by either method, the insert can optionally be sealed with a coating. The infused insert can be dried to the desired moisture content.

In an exemplary embodiment of high pressure infusing of additives in an immobilized additive insert, a 2 mm diameter white birch rod cut to 42 mm in length was placed in a pressure vessel, which was evacuated by a Welch W-series 8907A vacuum pump, rated at $10^{-4}$ Torr, running for about 20 minutes, and then charged with a flavor mixture of 60% menthol/40% propylene glycol. The pressure vessel was then pressurized to about 200 psi and held for about 25 minutes to infuse the menthol and propylene glycol into the white birch rod to form an immobilized additive insert. Optionally, the insert can be sealed with cross-linked pectin. The resulting immobilized additive insert from this exemplary embodiment can have a residual menthol level of about 32 mg per insert. It is noted that even after the infusion of the additives into the insert, the insert remains sufficiently robust such that the inserts can be manually or machine inserted into a smoking article without damaging (i.e., bending, breaking, releasing additives) or affecting the original shape of the insert.

In another exemplary embodiment of high pressure infusing of additives in an immobilized additive insert, a 2 mm diameter white birch rod cut to 42 mm in length was placed in a pressure vessel, which was evacuated by a Welch W-series 8907A vacuum pump, rated at $10^{-4}$ Torr, running for about 20 minutes, and then charged with vanillin. The pressure vessel was then pressurized to about 200 psi and held for about 10 minutes to infuse the vanillin into the white birch rod to form an immobilized additive insert. As a result of vanillin pressurized infusing, about 25.9 mg of vanillin was infused into the rod under pressure.

For comparison, a similar rod was subjected to long term soaking without applied pressure in an open vessel filled with a vanillin solution. The rod was soaked for about 20 hours to allow for the rod to absorb the vanillin. In this comparative example, only 17.4 mg of vanillin was absorbed in the rod. Thus, higher levels of additive can be achieved through pressurized infusion rather than non-pressurized absorption.

Also for comparison, 2.6 mm diameter bamboo rods were substituted for the white birch rods for the above high pressure infusion and the long term soaking. Under the same conditions discussed above, the bamboo rods contained about 15.6 mg of vanillin after a high pressure infusion, while only about 8.5 mg of vanillin after a long term soaking. Thus, much higher levels of vanillin can be infused as compared to non-pressurized, long term soaking conditions.

2) Cavity Infusing

An immobilized additive insert can also be formed by placing additive within a cavity of an elongated device, such as a hollow cylinder like a needle or hollowed toothpick. By providing a cavity, one or more additives can be immobilized within an insert, wherein the walls of the insert can immobilize the additive within the cavity.

A cavity can be provided by any known means, such as machining (e.g., drilling, piercing, etc.), molding, forming, etc. For example, if a wooden cylinder is provided, a cavity can be drilled into a portion of the cylinder.

After providing the cavity in the elongated device, the cavity can be filled with additive by any known technique, such as mechanical injection, capillary impregnation, etc. For example, if a small, capillary sized cavity is formed, a liquid additive can be infused into the cavity by capillary action.

It is noted that the insert can optionally be sealed with a coating, if further immobilization or isolation of additive is desired. For example, a thermally degradable polymer, such as pectin or wax, can be coated on an insert.

In order to take advantage of capillary action, inserts can be provided with cavities with diameters between about 0.5 to 3.0 mm in tubular inserts with diameters of between 1.0 mm to 5.0 mm. In exemplary embodiments, cavities with diameters of between about 1.5 to 2 mm for tubular inserts with diameters of between 3.0 to 4.0 mm.

In an exemplary embodiment of cavity infusing of additive in an immobilized additive insert 100, as illustrated in FIG. 1, a white birch wooden stick 110 (which may be substituted with any porous elongated insert) with a length of about 42 mm and a transverse cross-section of about 2 mm is drilled to form a cavity 120 that is about 1 mm in diameter by 30 mm long. Next, the wooden stick 110 can be dipped into a bath of molten or liquefied menthol, wherein the cavity can be filled with the menthol by capillary action. Next, the menthol can solidify in the cavity to provide about 25 to 30 mg of menthol. The open end of the wooden stick 110 can then be sealed with poly(vinyl acetate) emulsion glue. Alternatively, food grade paraffin wax or other acceptable materials can be used to seal the open end of the cavity in the wooden stick 110. As a result, an insert with menthol immobilized within a cavity can be formed. Additionally, the insert can be sealed with cross-linked pectin if desired.

3) Encapsulating Additives

Additives can be encapsulated by forming inserts that encapsulate additives therein. In an exemplary embodiment, a tube can be provided and filled with additives.

For example, a cellulosic or food use polymer tube can be provided, wherein the tube is preferably leak-resistant such that additive can be immobilized therein. Suitable tube materials include, but are not limited to, cellulosic materials such as paper, including tobacco based paper; and food use polymers, such as poly(ethylene oxide), poly(ethylene glycol), polyvinylpyrrolidone, polysaccharides, or bio-polymers.

The tubes used for encapsulating additives can be filled with additives, and then cut to a desired length and sealed at both ends. For example, a one foot long paper tube with an inner diameter of about 2 mm and an outer diameter of about 2.6 mm can be filled with molten or liquefied menthol. The tube can then be cut into small pieces to produce 1.5" long menthol tubes. The menthol tubes can then be sealed on both ends with polyvinyl acetate hot melt glue.

4) Layering Tobacco Sheets

An immobilized additive insert can also be formed by layering tobacco sheets, or tobacco webs, pre-loaded with additives. For example, a tobacco sheet can be formed by forming slurry of tobacco dust, particles, etc. along with additives then layered and cut to form inserts. In an exemplary embodiment, slurry of tobacco dust and additives can be formed and cast into sheets on a web forming machine. (Further discussion regarding forming of tobacco sheet methods can be found in commonly-assigned U.S. Pat. Nos. 6,026,820; 5,988,176; 5,915,387; 5,692,526; 5,692,525; 5,666,976; and 5,499,636, the disclosures of which are incorporated by reference herein in their entireties.) After forming the tobacco sheets, inserts can be made by layering the tobacco sheets, and then cutting the stacked sheets into inserts. For example, the inserts can be formed by stacking layer upon layer of the sheets, and then cutting the stacked layers into bar or rod shaped inserts.

Alternatively, the tobacco sheets can be cut into strips and rolled into cylinders, wherein the inserts can be rolled linearly or spirally to form bars or rods. If the insert is rolled linearly, a relatively uniform cylinder insert bar or rod can be formed, wherein the insert can include a hollow center portion. If the insert is rolled spirally, a tapered insert can be formed, wherein the insert can include a hollow center portion. Further discussion of rolling strips into bars or rods can be found in U.S. Pat. No. 4,304,245 to Lichfield, which is incorporated herein.

Additionally, the tobacco sheets can be rolled around a mandrel or rod, which can remain after insertion, to provide additional strength and rigidity, if desired.

C. Exemplary Additives

Additives can be added to smoking articles to achieve desirable added characteristics. The term "additive" as used herein is intended to include any material, chemical or component which modifies the characteristics of smoking articles and/or smoke produced when smoking the smoking articles. Any appropriate additive or combination of additives may be contained within inserts to modify the characteristics of the smoking articles and/or smoke produced when smoking the smoking articles in which the inserts are incorporated.

Additives can be provided in liquid and/or solid form. For example, molten menthol can be added, and then solidified within an insert. Alternatively, capsules with liquid additives therein, such as polysaccharide capsules filled with menthol and a solvent can be incorporated into an insert. As used herein, additives can include, but are not limited to, flavorants, diluents, sorbents, combustion rate controlling compositions, humectants, or combinations thereof.

By providing inserts, high levels of additives can be provided to smoking articles. For example, up to about 50 mg of additive can be added in each insert, and more than one insert can be used with a smoking article if desired.

One of the more common smoking article additives is menthol, due to its mint flavoring and cooling effects that it can impart to tobacco smoke. However, menthol is highly volatile and can vaporize and gradually escape from the smoking article during storage or be adsorbed by sorbents within the smoking article. Thus, due to the potential loss of menthol in a smoking article, controlling the concentration of menthol in a smoking article is difficult. As such, the insert's immobilization of additives, especially additives with high volatility, can be used to control the concentration of the additives as desired.

In an exemplary embodiment, the inserts can be added to smoking articles, such as cigarettes, and may include one or more flavorants. The term "flavorant" or "flavor" may include any flavor compound suitable for being releasably disposed to provide a taste to tobacco smoke. For example, a flavorant containing insert may be combusted along with a tobacco rod of a cigarette during smoking to release flavorant from the insert into the smoke produced, and thus flavor the smoke produced.

For example, a cigarette with a menthol flavored insert can be provided. The insert can be provided with the menthol by infusing the menthol into the insert under high pressure, filling a cavity in an insert with menthol, encapsulating menthol within an insert, and/or forming an insert from a slurry including menthol.

Suitable flavorants include natural flavorants, synthetic flavorants, or combinations thereof. Exemplary flavorants include, but are not limited to, menthol, mint, such as peppermint and spearmint, chocolate, licorice, citrus and other fruit flavors, gamma octalactone, vanillin, ethyl vanillin, breath freshener flavors, spice flavors such as cinnamon, methyl salicylate, linalool, bergamot oil, geranium oil, lemon oil, ginger oil, and tobacco flavor. Other suitable flavorants may include flavor compounds selected from the group consisting of an acid, an alcohol, an ester, an aldehyde, a ketone, a pyrazine, combinations or blends thereof and the like. Suitable flavorants may also be selected, for example, from the group consisting of phenylacetic acid, solanone, megastigmatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, iso-valeric acid, combinations thereof and the like.

Alternative or additionally, an insert can include diluents as additives therein. Suitable diluents include chemicals that can be used to dilute other additives, such as flavorants, and/or can be used alone. For example, a diluent can be used to dilute particulate matter in mainstream smoke. Exemplary diluents include, but are not limited to propylene glycol, ethylene glycol, diethylene glycol, triacetin, ethyl laurate, diethyl suberate, triethylene glycol, glycerin, ethyl vanillate, triethyl citrate, tributyrin, diethyl sebacate, benzyl phenyl acetate, benzyl benzoate, erythritol, tetraethylene glycol, ethyl stearate, dioctyl sebacate.

Alternative or additionally, an insert can include catalysts or sorbents as additives therein. Suitable catalysts and sorbents include materials that can modify mainstream smoke by catalytic reaction or adsorption/absorption. Exemplary catalysts and sorbents include, but are not limited to, iron oxide particles, such as nanometer-sized iron oxide particles, carbon nanotubes, activated carbon, molecular seives, such as zeolites, or any other sorbents that can fit within a portion of the insert.

Alternative or additionally, an insert can include combustion rate controlling compositions as additives therein to increase or decrease the combustion rate of the tobacco and/or the insert. Suitable combustion rate controlling compositions include chemicals that can increase or decrease the combustion rate of a tobacco rod or an insert. For example, combustion rate controlling compositions can be added to tobacco in a cigarette and/or an insert such that the cigarette can be degraded by combustion (i.e., burn down) at the same rate as each other. Exemplary combustion rate controlling compositions include, but are not limited to, humectants, flavorants, oils, alkali metals, alkaline-earths containing salts, alkali metal salts of carboxylic acids such as acetic acid, citric acid, malic acid, lactic acid, tartaric acid and the like, or phosphates. Further discussion regarding controlling combustion rate can be found in commonly-assigned U.S. Pat. No. 6,637,439, the disclosure of which is incorporated by reference herein in its entirety.

Alternative or additionally, an insert can include humectants. Suitable humectants include chemicals that can aid in the delivery of flavor, provide moisture to mainstream smoke, deliver flavors via the particulate phase of mainstream smoke (bypassing sorbents in a smoking article), and/or act as diluents to mainstream smoke particulate generated from tobacco during smoking. Exemplary humectant compositions include, but are not limited to, propylene glycol, glycerine, and sorbitol.

D. Elongated Devices

Immobilized additive inserts can be provided as elongated devices with additives therein, such that the shape of the insert can fit within a smoking article, such as a cigarette. The term "elongated device" is intended to include any device made of a shaped material with: 1) sufficient additive carrying capacity; 2) suitable decomposition properties; and 3) suitable robustness or strength. For example, an elongated device should have 1) sufficient additive carrying capacity, such that sufficient amounts of additives can be provided within the elongated devices. Additionally, the elongated device should have 2) suitable decomposition properties, such that the elongated devices are combusted or decomposed at approximately the same rate as the smoking article. Also, the elongated device should have 3) suitable robustness or strength, such that the elongated devices can withstand manual or machine insertion into a tobacco rod without breaking and can withstand mechanical manipulation for additive loading, such as cavity formation, pressurized injection of additives, etc.

Exemplary materials include, but are not limited to, cellulosic materials, such as wood, such as white birch, bamboo, paper, and tobacco; and food use polymeric materials, such as polysaccharides, polyvinyl acetate, poly(ethylene oxide), poly(ethylene glycol), and polyvinylpyrrolidone. It is noted that the density/carrying capacity of the insert may also be adjusted to adjust the coals formed therefrom. For example, less dense materials tend to form less dense coals during smoking, thus the coal from the less dense insert may be more easily extinguished.

An exemplary cellulosic material is white birch. White birch is preferable in that it is inexpensive, and also provides the desired levels of additive carrying capacity, decomposition properties, and robustness.

Another exemplary cellulosic material is balsa wood. While balsa wood has a lower density than white birch, which can lower the robustness of the insert, the lower density can also allow for higher infusion and thus increased additive carrying capacity. Additionally, by using balsa wood, hollow cavities may be formed by impinging a sharp object into the balsa wood due to its low density, as long as the balsa wood is not damaged by the impinging action.

Exemplary shapes for the inserts include cylinders, tapered rods, cones, etc., wherein the transverse cross-sectional areas can have any shape, such as circular, triangular, square, etc. The shapes can include geometries that are compatible with other desired characteristics. For example, a tapered insert can be provided with a narrow end closer to the mouth end of a cigarette and a wide end closer to the lit end of the cigarette, such that more additive can be thermally released closer to the lit end. By providing more additive closer to the lit end, a first puff can have more additive therein than a second puff. As such, if menthol is added, a first puff on a cigarette can have higher levels of menthol than the remaining puffs due to the geometry of the insert with the menthol therein.

Additionally, the elongated devices can be shaped such that the length and width are sized for use in specific smoking articles. In exemplary embodiments, inserts can be provided that are round or oval in cross section, slightly shorter in length and smaller in diameter than tobacco rod portions of cigarettes. The round cross section can allow for better consumption in a round cigarette; the slightly shorter length can allow the insert to not protrude from the lit end of the cigarette; and the smaller diameter can allow the insert to not burst the cigarette upon insertion. For example, in an 84 mm long, 8 mm diameter standard cigarette with a 60 mm length tobacco rod, a rounded insert with a 32-42 mm length and a 2 mm diameter can be used to provide additives within the smoke derived from the cigarette, wherein the insert fits within the cigarette without overpacking the tobacco rod region of the cigarette.

The insert can also be formed with tapered or sharpened ends such that the tapered or sharpened ends can aid insertion into a smoking article. By providing tapered or sharp ends, the elongated device can slide between portions of tobacco filler in a tobacco rod, or can slide between tobacco and a paper wrap surrounding the tobacco rod.

The elongated devices can be shaped by molding, machining, etc. provided that the strength of the devices is not adversely affected. For example, a hollow elongated device can be molded from slurry of tobacco dust and adhesive provided that sufficient strength is provided for insertion of the hollow elongated device into a smoking article. As another example, a balsa wood stick can be cut into a cylinder, and a hole can be drilled through a center portion of the stick to form a hollow cylinder. As yet another example, a polymer can be extruded as a hollow cylinder.

Preferably, the materials and shapes of the elongated device are selected to have burn characteristics, strength, and additive carrying capability as desired. For example, an insert made of birch wood can be shaped such as to burn at approximately the same rate as tobacco in a cigarette, while also having the strength to withstand insertion into the cigarette forces without breaking, as well as carrying sufficient levels of menthol to flavor the cigarette.

Additionally, an insert can be shaped to improve flavor delivery in a first puff of a cigarette. For example, a common complaint among smokers is that the first, or ignition, puff has less taste than the other puffs of a cigarette. In order to address this issue, an insert can be provided that is designed to provide more taste to a first puff. For example, an insert with a wider end loaded with more flavor content can be placed into a tobacco rod with the wider end disposed toward the lit end of the cigarette. Upon ignition, higher levels of flavor can be released from this wider end to compensate for the otherwise lower taste levels. Additionally, during the smoking of the remainder of the cigarette with the insert therein, the flavor can be made to taper off or be maintained as desired. Similarly, control of the shape and geometry of the insert can be used to provide delivery of comparable levels of additive or flavorant in each puff taken from the smoking article. Because flavorants and additives can sometimes move down the tobacco rod during smoking and can then condense at a location closer to the user, potentially giving higher deliveries of additive or flavorant in later puffs. By controlling the geometry and shape of the insert (e.g., by tapering the insert at the end toward the user), the amount of additive or flavorant supplied by the insert at that end is decreased, so that the total amount of additive or flavorant experienced by the user can be maintained or controlled.

E. Sealants

Exemplary sealants include waxes and polymers, which can be used to encapsulate and further immobilize additives within an insert. An exemplary wax includes food grade paraffin wax. An exemplary polymer includes polysaccharides. While other waxes and polymers can be used, preferably the encapsulant polymers are biocompatible, non-toxic and hypo-allergenic.

Polysaccharides are preferred for sealing additives with inserts because they can be made water insoluble and relatively heat stable at lower temperatures (e.g., below about 75° C.) through cross-linking. Further, cross-linked polysaccharides are cross-linked by salt bridges between polysaccharide chains which can maintain the stability and shape of the additives. Additionally, polysaccharides are also preferred because polysaccharides can be heated and burned to yield tasteless products, thus allowing for additives immobilized by the polysaccharides to be released upon heating without altering a taste of the additive.

In order to seal the cavity in an insert, an open end of the cavity can be sealed using an adhesive or wax. Exemplary glue includes poly(vinyl acetate) emulsion glue. An exemplary wax includes food grade paraffin wax.

Additionally, coatings can be provided to further immobilize additives in the inserts. As exemplary embodiments of the inserts include porous materials, such as birch wood sticks, further immobilization may be desired to reduce loss through porous side walls of the inserts. These optional coatings can be provided before or after filling a cavity, but can also be provided after high pressure infusion of additives. Exemplary coatings include food grade paraffin wax and cross-linked polysaccharides.

F. Insertion of Immobilized Additive Inserts

Figure 2:
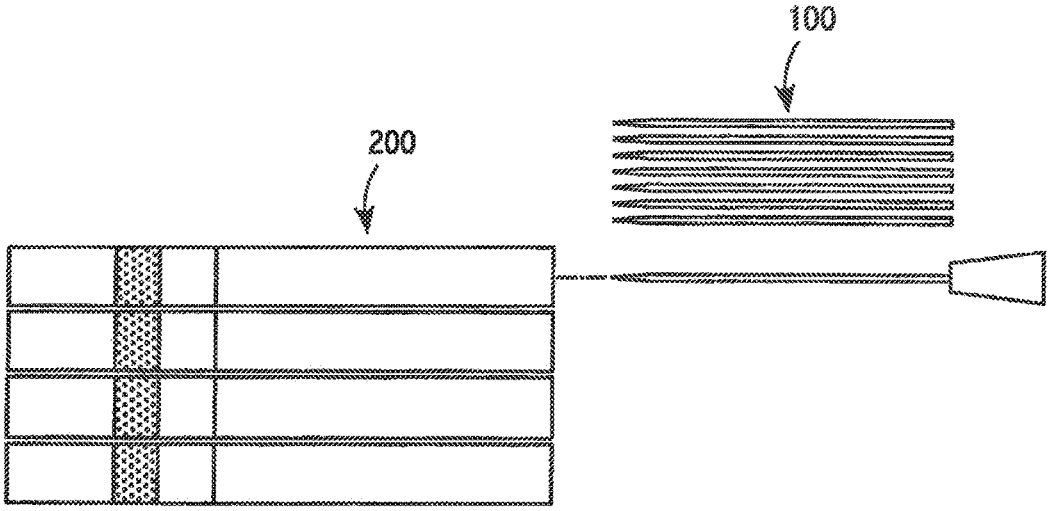
FIG. 2 is an illustration of an exemplary method of inserting an immobilized additive insert in a cigarette.

The inserts can be inserted into smoking articles at any time such that the inserts are available to a smoker prior to smoking. For example, as illustrated in FIG. 2, the inserts 100 can be inserted into smoking articles 200 during production of the smoking articles, wherein a mechanical pushing device can push an insert 100 into a smoking article. In an exemplary embodiment, the inserts 100 can be dropped into place in front of the mechanical pushing device, or the mechanical pushing device can move to pick up an insert 100, then the smoking articles 200 can be held stationary or can be moved relative to the inserts 100 such that the inserts are placed within the smoking articles 200. Alternatively, placing inserts into smoking articles can occur at the smoker's level of use, wherein a smoker can manually place the inserts in a smoking product as desired.

Figure 4:
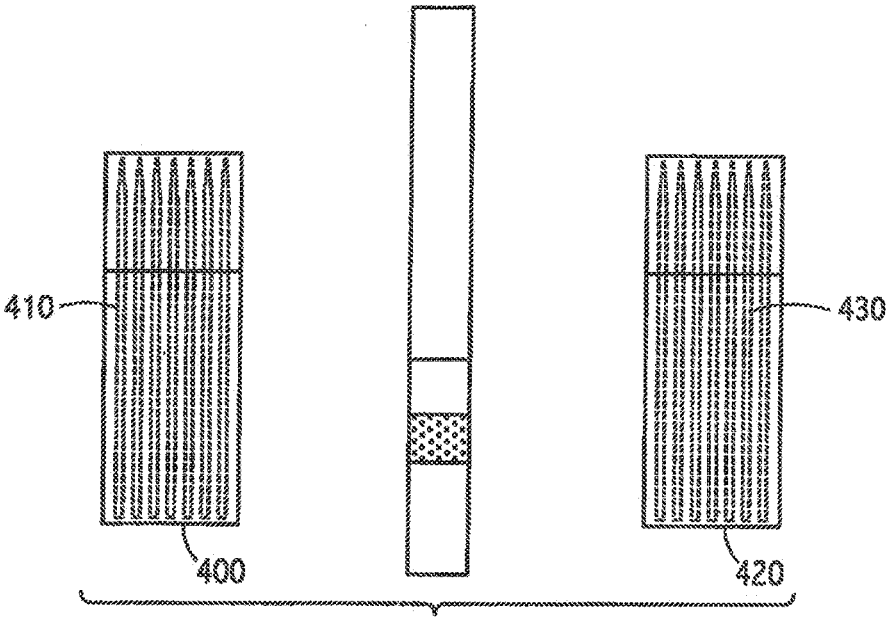
FIG. 4 is an illustration of exemplary packages of immobilized additive inserts and a cigarette.

The inserts can be provided with or without smoking articles. For example, the inserts can be provided already inserted into the smoking articles prior to packaging as a part of the smoking articles, as illustrated in FIG. 2; or the inserts can be provided separately for use with separately packaged smoking articles, as illustrated in FIG. 4. As illustrated in FIG. 2, the smoking articles can be manufactured with the inserts placed into the smoking articles prior to the packaging of the smoking articles. On the other hand, the inserts can be provided in one or more packages of inserts separate from the smoking articles, wherein a smoker can place one or more inserts into a smoking article just prior to smoking the smoking article.

The inserts can be inserted into locations of the smoking articles, wherein the locations can be selected to provide sufficient heat levels to degrade the inserts. By incorporating inserts into the cut filler, the additives can be exposed to heat when the smoking article is smoked and the inserts can be degraded to thereby release the additives into the mainstream smoke of the smoking article.

G. Smoking Articles

It is envisioned that immobilized additive inserts may be used in any smoking articles. When using the inserts in combustible smoking articles, the inserts can preferably have a rate of combustion approximating the rate of combustion of the tobacco in the smoking articles.

Figure 3:
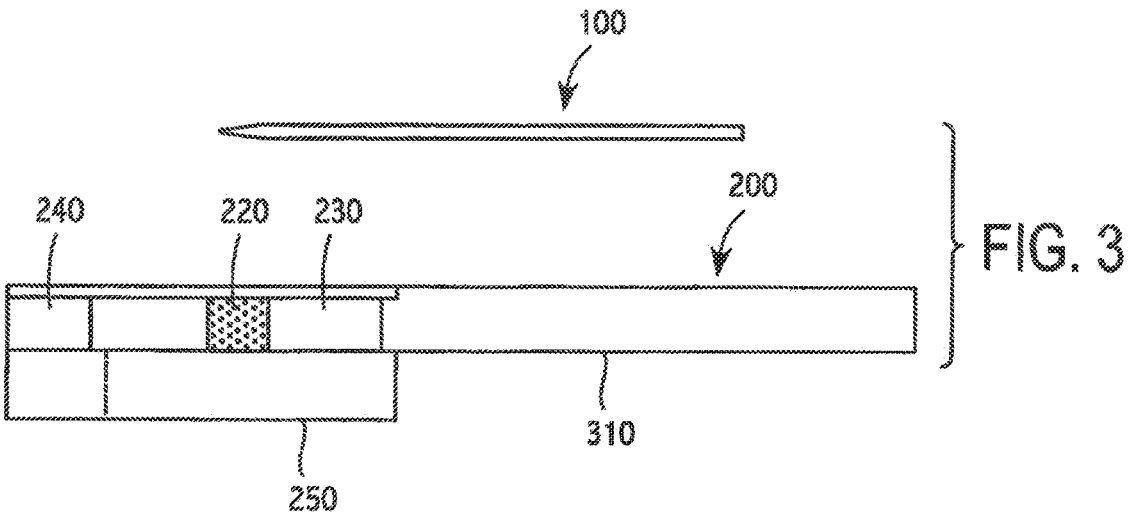
FIG. 3 is an illustration of an immobilized additive insert and a cigarette including sorbent.

Exemplary smoking articles that can be used with inserts 100 include cigarettes and cigars, such as cigarettes 200 containing sorbent 220, as illustrated in FIG. 3. By including sorbent, levels of targeted constituents of mainstream smoke, such as benzene, acrolein or 1,3-butadiene can be reduced. However, as mentioned above, levels of non-targeted constituents, such as flavors and additives, can also be reduced. By providing additives within inserts, the additives can be isolated from the sorbent during storage, thus reducing undesired sorption of the additives by the sorbent.

The term "mainstream smoke" includes the mixture of gases and/or aerosols passing down a smoking article, such as a tobacco rod, and issuing from an end, such as through the filter end, i.e., the amount of smoke issuing or drawn from the mouth end of a cigarette during smoking of the cigarette. The mainstream smoke contains air that is drawn in through the heated region of the cigarette and through the paper wrapper.

"Smoking" of a cigarette (or smoking article) means the heating, combusting or otherwise causing a release of certain chemicals from tobacco. Generally, smoking of a cigarette involves lighting one end of the cigarette and drawing the smoke downstream through the mouth end of the cigarette, while the tobacco contained therein undergoes a combustion reaction. However, the cigarette may also be smoked by other means, as mentioned above.

As illustrated in FIG. 3, a cigarette 200 can contain two sections, a tobacco-containing portion sometimes referred to as the tobacco or cigarette rod 310, and a filter portion with optional sorbent 220 surrounded by filter material 230, 240, such as cellulose acetate. The filter portion can be surrounded by tipping paper 250, which forms a mouth end of the cigarette. The tipping paper 250 can overlap with the tobacco rod in order to hold the filter and tobacco rod 310 together. The tobacco rod 310, or tobacco containing element of the cigarette, can also include a paper wrapper surrounding the tobacco rod 310, wherein an adhesive can be used to hold the seams of the paper wrapper together.

1. Sorbent Materials

As used herein, a "sorbent" is a substance that has the ability to condense or hold molecules of one or more tobacco smoke constituents on its surface and/or the ability to take up such components, e.g., through penetration into its inner structure or into its pores. The term "sorbent" as used herein refers to an adsorbent, an absorbent, or a substance that can function as both an adsorbent and an absorbent. The term "sorption" is intended to encompass interactions on the outer surface of sorbents such as activated carbon, zeolites and other like materials, as well as interactions within the pores and channels thereof.

Suitable sorbents include various forms of activated carbon, molecular sieves, such as zeolites, and mixtures thereof. Activated forms of carbon have strong physical adsorption forces, and high volumes of adsorbing porosity. The activated carbon could be manufactured by any suitable technique. One technique is the carbonization of coconut husk, coal, wood, pitch, cellulose fibers, or polymer fibers, for example. Carbonization is preferably carried out at high temperatures, i.e., 500-900° C. in an inert atmosphere, followed by activation under reducing conditions. The activated carbon used in the smoking articles could be in the form of monolithic shapes, granules, beads, powders or fibers. If desired, the activated carbon can be incorporated in another material such as paper.

Activated carbon may include a distribution of micropores, mesopores and macropores. The term "microporous" generally refers to such materials having pore sizes of about 20 Å or less while the term "mesoporous" generally refers to such materials with pore sizes of about 20 to 500 Å. The term "macroporous" refers to pore sizes above 500 Å. The relative amounts of micropores, mesopores and macropores can be pre-selected relative to the selected components from mainstream tobacco smoke that are to be targeted and removed. Thus, the pore sizes and pore distribution can be adjusted accordingly as needed for a certain application.

Another material which may be used as a sorbent in the filter system of the smoking article is a molecular sieve zeolite. The term "molecular sieve" as used herein refers to an inorganic porous structure. Zeolites have channels or pores of uniform, molecular sized dimensions. There are many known unique zeolite structures having different sized and shaped channels or pores. The size and shape of the channels or pores can significantly affect the properties of these materials with regard to adsorption and separation characteristics. Zeolites can be used to separate molecules in the channels or pores, and/or by differences in strength of sorption. By using one or more zeolites having channels or pores larger than selected constituents of mainstream smoke, only selected molecules that are small enough to pass through the pores of the molecular sieve material are able to enter the cavities and become sorbed by the zeolite.

Zeolite-type molecular sieves which are useful in smoking articles include ZSM-5, A, X, and Y-type zeolites. Other molecular sieves which can be useful in smoking articles include silicoaluminophosphates and mesoporous molecular sieves, such as MCM-41, MCM-48 and SBA-15. These are preferably granular materials. This family of materials contains regular arrays of uniformly-sized channels and tunable internal active sites, and admits molecules below a certain size into their internal space which makes them useful as catalysts and adsorbents where selectivity is desired. Microporous, mesoporous and/or macroporous molecular sieves may be used. They are selected for use in a filter system based on the particular constituent(s) to be removed from the mainstream smoke.

The sorbent can be incorporated in one or more locations of the smoking article. For example, the sorbent can be placed in the passageway of a tubular free-flow filter component, in the material of a filter component, and/or in a void space of a filter. The sorbent can additionally or alternatively be incorporated in a tobacco material or wrapper of a smoking article.

Alternatively, the sorbent can be composed of one or more sorbent materials, such as carbon, silica, zeolite and the like, impregnated in micro-cavity fibers, such as TRIAD™ micro-cavity fiber manufactured by Honeywell International of Morristown, New Jersey See commonly assigned U.S. Pat. Nos. 6,584,979, 6,772,768 and 6,779,528 which are hereby incorporated by reference in their entirety. The fibers may be shaped micro-cavity fibers impregnated with particles of one or more sorbent materials.

Sorbent can be incorporated in a cigarette filter at one or more desired locations. For example, a sorbent segment can be combined with a free-flow filter. The sorbent can be in contact with (i.e., abut) a free-flow filter positioned between the free-flow filter and a mouthpiece filter plug or in contact with (i.e., abut) a mouthpiece filter plug. The sorbent segment can have a diameter substantially equal to that of the outer diameter of a free-flow filter to minimize by-pass of smoke during the filtration process.

Fibrous sorbent-containing filter segments can have a high loft with a suitable packing density and fiber length such that parallel pathways are created between fibers. Such structure can effectively remove selected gas-phase constituents, such as formaldehyde and/or acrolein, while removing minimal amounts of particulate matter from the smoke, thereby achieving a significant reduction of the selected gas-phase constituents, while not significantly affecting the total particulate matter (TPM) in the tobacco smoke. A low packing density and a short fiber length can be used to achieve such filtration performance.

The amount of sorbent used in exemplary embodiments of the smoking article depends on the amount of selected gas-phase constituents in the tobacco smoke and the constituents to be removed from the tobacco smoke.

When sorbents and additives are used in smoking articles, additives can deactivate sorbents by being sorbed within the sorbents. Thus, to reduce the level of deactivation of sorbent, additives are preferably immobilized within inserts to reduce the interaction between the sorbent and additives prior to use of the smoking article.

2. Tobacco

Examples of suitable types of tobacco materials that may be used include, but are not limited to, flue-cured tobacco, Burley tobacco, Maryland tobacco, Oriental tobacco, rare tobacco, specialty tobacco, blends thereof and the like. The tobacco material may be provided in any suitable form, including, but not limited to, tobacco lamina, processed tobacco materials, such as volume expanded or puffed tobacco, processed tobacco stems, such as cut-rolled or cut-puffed stems, reconstituted tobacco materials, blends thereof, and the like. Tobacco substitutes may also be used.

In traditional cigarette manufacture, the tobacco is normally used in the form of cut filler, i.e., in the form of shreds or strands cut into widths ranging from about 2 mm to about 1 mm or even about 0.5 mm. The lengths of the strands range from between about 5 mm to about 80 mm. The cigarettes may further comprise one or more flavors, or other suitable additives (e.g., burn additives, combustion modifying agents, coloring agents, binders, etc.).

3. Examples

Figure 5:
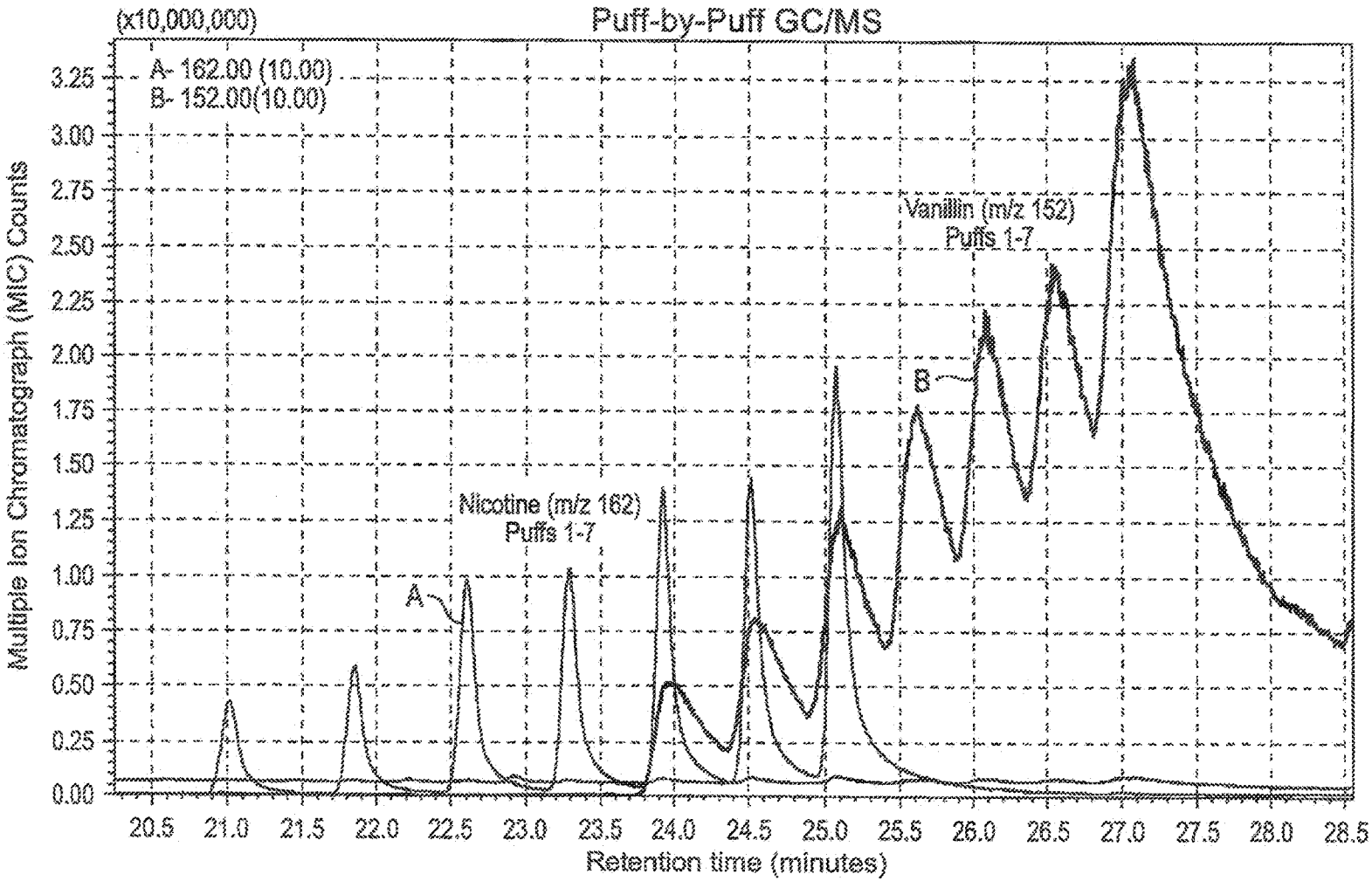
FIG. 5 is a gas chromatography (GC)/mass spectroscopy (MS) plot showing the intensities for mass to charge ratio (hereinafter "m/z") 162 (nicotine) and m/z 152 (vanillin) as a function of retention time for seven puffs of an exemplary plug-space-plug (psp) activated carbon-containing filtered test cigarette with an exemplary immobilized vanillin pressure infused wooden insert in the tobacco rod.

When an exemplary cigarette includes immobilized additive inserts, a gas chromatography (GC)/mass spectroscopy (MS) spectrum can be obtained to determine the effect of the inserts on the mainstream whole smoke delivery levels during smoking. The exemplary cigarette tested for the purposes of preparing FIG. 5 included a plug-space-plug (psp) activated carbon-containing filtered test cigarette with an immobilized vanillin pressure infused insert (e.g., wooden insert) in the tobacco rod. The intensities of mass to charge (m/z) ratios of 162 and 152, predominantly associated with nicotine and vanillin, respectively, are shown as a function of retention time for seven puffs of the cigarette. FIG. 5 indicates that a sufficient amount of vanillin is delivered in the mainstream smoke through the activated carbon bed.

Exemplary cigarettes tested for the purposes of preparing FIGS. 6 and 7 included a commercial cigarette, with no activated carbon, with menthol diffused, by conventional means, throughout the cigarette (hereinafter "control menthol cigarette"), a plug-space-plug activated carbon-containing filtered test cigarette with an immobilized menthol pressure infused insert in the tobacco rod (hereinafter "insert containing cigarette"), and a plug-space-plug activated carbon-containing filtered test cigarette without menthol (hereinafter "activated carbon cigarette").

Figure 6:
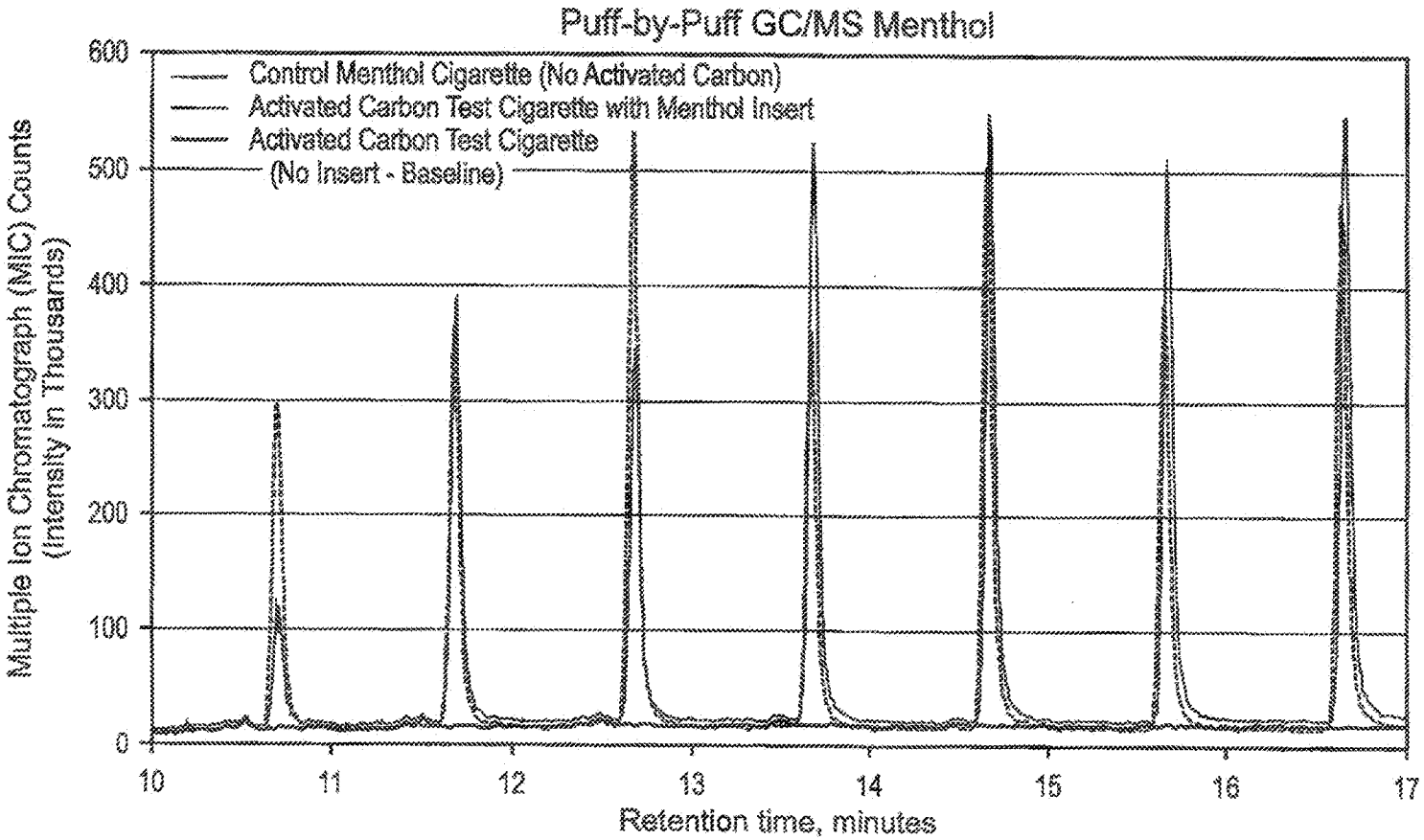
FIG. 6 is a GC/MS plot showing the intensities for menthol mass fragments (m/z 71+123) as a function of retention time for seven puffs of; 1) an exemplary commercial cigarette with no activated carbon and menthol diffused, by conventional means, throughout the cigarette, 2) an exemplary plug-space-plug activated carbon-containing filtered test cigarette with an immobilized menthol pressure infused wooden insert in the tobacco rod, and 3) an exemplary plug-space-plug activated carbon-containing filtered test cigarette without menthol.
Figure 7:
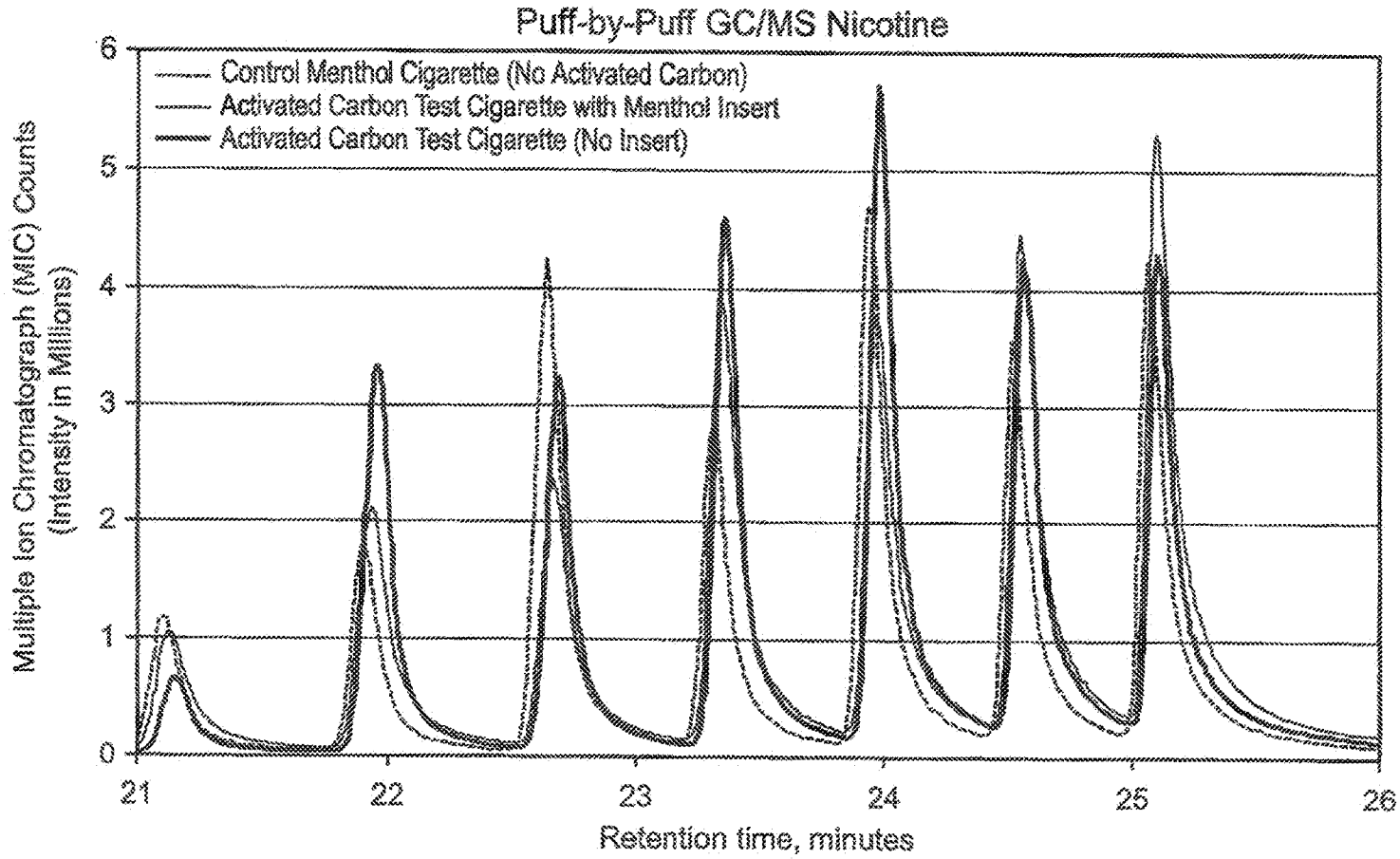
FIG. 7 is a GC/MS plot showing the intensities for nicotine mass fragments (m/z 84+133) as a function of retention time for seven puffs of; 1) an exemplary commercial cigarette with no activated carbon and menthol diffused, by conventional means, throughout the cigarette, 2) an exemplary plug-space-plug activated carbon-containing filtered test cigarette with an immobilized menthol pressure infused wooden insert in the tobacco rod, and 3) an exemplary plug-space-plug activated carbon-containing filtered test cigarette without menthol.

As shown in FIG. 6, comparable levels of menthol are delivered for the insert containing cigarette as compared to that of the control menthol cigarette. Additionally, as shown in FIG. 7, the total delivery of nicotine for each of the three cigarettes is comparable. Thus comparable amounts of menthol can be delivered through an activated carbon bed with the use of an immobilized menthol insert as can be delivered in a conventional menthol cigarette where the menthol is diffused throughout the cigarette and contains no activated carbon, and it does not appear that the nicotine levels are affected by the use of a combustible insert. Additional data (not shown) indicated no affect on the activated carbon's ability to adsorb various undesirable gas phase compounds during smoking.

H. Packaging

Immobilized additive inserts can be packaged with or separately from smoking articles. In an exemplary embodiment, the inserts are placed into the smoking articles during manufacture, then the smoking articles are packaged for distribution. By providing the inserts in the smoking articles during manufacture, a smoker can enjoy the additives without having to place the insert into the smoking articles.

Alternatively, the inserts can be packaged separately from the smoking articles. In an exemplary embodiment, a package of immobilized additive inserts 100 can be provided as a kit with the smoking articles, or separately as a stand alone product with several inserts in a package, as illustrated in FIG. 4. The inserts can then be removed from their packaging and inserted into smoking articles.

One advantage of providing inserts separately from smoking articles is that more than one insert can be used with a smoking article if desired. For example, a single menthol flavored insert can used to provide low levels of menthol flavor to a cigarette or two menthol flavored inserts can be used to provide higher levels of menthol flavor to the same cigarette.

Additionally, different types of additives can be used with a smoking article. For example, an insert comprising an anti-inflammatory compound can be used in conjunction with a menthol flavored insert to provide both additives to a smoking article. As another example, as illustrated in FIG. 4, different inserts 410 and 430 from different packages 400 and 420, respectively, which can be used with a cigarette such that if the first package 400, includes menthol inserts 410, while the second package 420 includes vanillin inserts 430, a cigarette can be flavored with both menthol and vanillin.

Another advantage of providing inserts separately from smoking articles is that loss of more volatile additives can be mitigated. For example, if menthol is not completely immobilized by an insert, the packaging of the inserts can isolate the menthol from the environment and the smoking articles prior to smoking. For example, inserts can be provided in blister packs to reduce loss or migration of the additives.

While the invention has been described in detail with reference to specific embodiments thereof, it will be apparent to one skilled in the art that various changes and modification may be made, and equivalents thereof employed, without departing from the scope of the claims.

The invention claimed is:

1. A smoking article comprising:
a tobacco rod;
a hollow region defined in the tobacco rod, the hollow region having an average diameter between 0.5 mm and 3.0 mm; and
a robust immobilized additive insert inserted into the hollow region, the robust immobilized additive including a thermally degradable elongated device, the thermally degradable elongated device having an end configured to allow the robust immobilized additive insert to be pushed into the hollow region.

2. The smoking article of claim 1, wherein the robust immobilized additive insert is coated with a sealant prior to insertion into the smoking article.

3. The smoking article of claim 1, wherein the robust immobilized additive insert maintains its original shape during insertion into the tobacco rod.

4. The smoking article of claim 1, wherein the robust immobilized additive insert is prepared by:
adding an additive into the hollow region;
pressurizing an absorbent elongated device in an additive containing pressurized vessel to a pressure of at least 20 psi such that additives are absorbed within the elongated device;
encapsulating additives within a leak-resistant elongated device;
layering additive-containing tobacco sheets and forming the insert from the layered additive-containing tobacco sheets;
infusing additives by vacuum infiltration into an elongated device; or
any combination thereof.

5. The smoking article of claim 4, wherein the absorbent elongated device has been pressurized in an additive-containing pressurized vessel to a pressure of at least 100 psi.

6. The smoking article of claim 4, wherein the absorbent elongated device has been pressurized in an additive-containing pressurized vessel to a pressure of at least 200 psi.

7. The smoking article of claim 4, wherein the leak-resistant elongated device is a paper tube.

8. The smoking article of claim 7, wherein the paper tube has an inner diameter of 2 mm and an outer diameter of 2.6 mm.

9. The smoking article of claim 4, wherein
the forming of the robust immobilized additive insert includes layering additive containing tobacco sheets, and
layering includes:
forming a slurry of tobacco and additive;
forming tobacco sheets from the slurry;
drying the tobacco sheets;
layering and adhering two or more tobacco sheets on one another to form a layered tobacco composite; and
cutting the layered tobacco composite into an elongated shape to form the robust immobilized additive insert.

10. The smoking article of claim 1, wherein the elongated device includes a needle or hollowed toothpick.

11. The smoking article of claim 1, wherein the elongated device has a transverse dimension of 0.5 mm to 3.0 mm, a length of 30 mm to 42 mm, or both a transverse dimension of 0.5 mm to 3.0 mm and a length of 30 mm to 42 mm.

12. The smoking article of claim 1, wherein the robust immobilized additive insert includes between 5 mg and 50 mg of an additive.

13. The smoking article of claim 12, wherein the additive includes menthol, propylene glycol, glycerine, or any combination thereof.

14. The smoking article of claim 12, wherein the additive includes a flavorant material.

15. The smoking article of claim 12, wherein the additive includes a diluent material.

16. The smoking article of claim 12, wherein the additive includes a sorbent material.

17. The smoking article of claim 12, wherein the additive includes a humectant material.

18. The smoking article of claim 1, wherein the end is tapered or sharpened.

19. The smoking article of claim 1, wherein the end is a first end and the robust immobilized additive insert includes a second end distal from the first end, wherein the second end is sealed using an adhesive or wax.

* * * * *